US005738152A

United States Patent [19]

Crittenden

[11] Patent Number: 5,738,152

[45] Date of Patent: Apr. 14, 1998

[54] COMPACT HAND OPERATED PNEUMATIC STRAPPING TOOL

[75] Inventor: David Crittenden, Schaumburg, Ill.

[73] Assignee: Illinois Tool Works Inc., Glenview, Ill.

[21] Appl. No.: 801,175

[22] Filed: Feb. 18, 1997

Related U.S. Application Data

[63] Continuation of Ser. No. 509,356, Jul. 31, 1995, abandoned.

[51] Int. Cl.[6] ..... B21F 15/04

[52] U.S. Cl. ..... 140/93.4; 140/150

[58] Field of Search ..... 140/93.2, 93.4, 140/150, 152

[56] References Cited

U.S. PATENT DOCUMENTS 2,040,576 5/1936 Timmerbeil ..... 140/93.2

3,319,666 5/1967 Langford et al. ..... 140/93.2

3,506,041 4/1970 Angarola ..... 140/93.4

*Primary Examiner*—Lowell A. Larson

*Attorney, Agent, or Firm*—Dvorak & Orum

[57] ABSTRACT

A compact hand-operated pneumatic strapping tool is disclosed. The tool has a compact arrangement of the sealing and the tensioning valves, and a combination sealing motor/valve module arrangement. A cam driven tooth terminates the sealing step. The valve/motor arrangement results in a more compact and lighter weight strapping tool, for drawing a steel strap around a load, and sealing the strap by punching interlocking slits into the strap ends.

4 Claims, 2 Drawing Sheets

COMPACT HAND OPERATED PNEUMATIC STRAPPING TOOL

CROSS REFERENCE TO RELATED APPLICATIONS

This application is a continuation of application Ser. No. 08/509,356, filed 31 Jul. 1995, now abandoned.

The invention set out in this application is related to the invention set out in U.S. Ser. No. 08/370,533, filed Jan. 9, 1995, now U.S. Pat. No. 5,518,043 granted May 21, 1996.

BACKGROUND OF THE INVENTION

1. Field of the Invention

The present invention pertains to the field of drawing a steel strap around a load, and sealing the strap in the drawn position. Particularly, the invention relates to lightweight, hand-held tools which accomplish this task.

2. Description of Related Art

Strapping tools are in use for the purpose of drawing a steel strap around a load, sealing the strap, and cutting the strap. Hand-operated tools have been proposed for addressing this task. However, many prior art tools suffer from shortcomings such as large size, and heavy weight, making them difficult to manipulate by hand.

The present invention addresses and solves the problems associated with hand-held strapping tools which are overly heavy and large in size, by proposing a smaller and lighter weight device which performs all of the necessary strapping functions.

SUMMARY OF THE INVENTION

The present invention addresses and solves the problems existing with prior art strapping machines with respect to overly large size and heavy weight. Specifically, the present invention discloses a compact pneumatic valve assembly, and a compact sealing motor valve assembly arrangement. A toothed release cam, driven by the sealer cam, acts to terminate the sealing step. The arrangement of the tensioning and sealing valves with respect to the sealer motor, and the arrangement of the gear package, sealer motor/valve assembly, sealer cams, and tension motor contribute to the compact size, light weight, and reliable operation of the present invention.

DESCRIPTION OF THE PREFERRED EMBODIMENT

Figure 1:
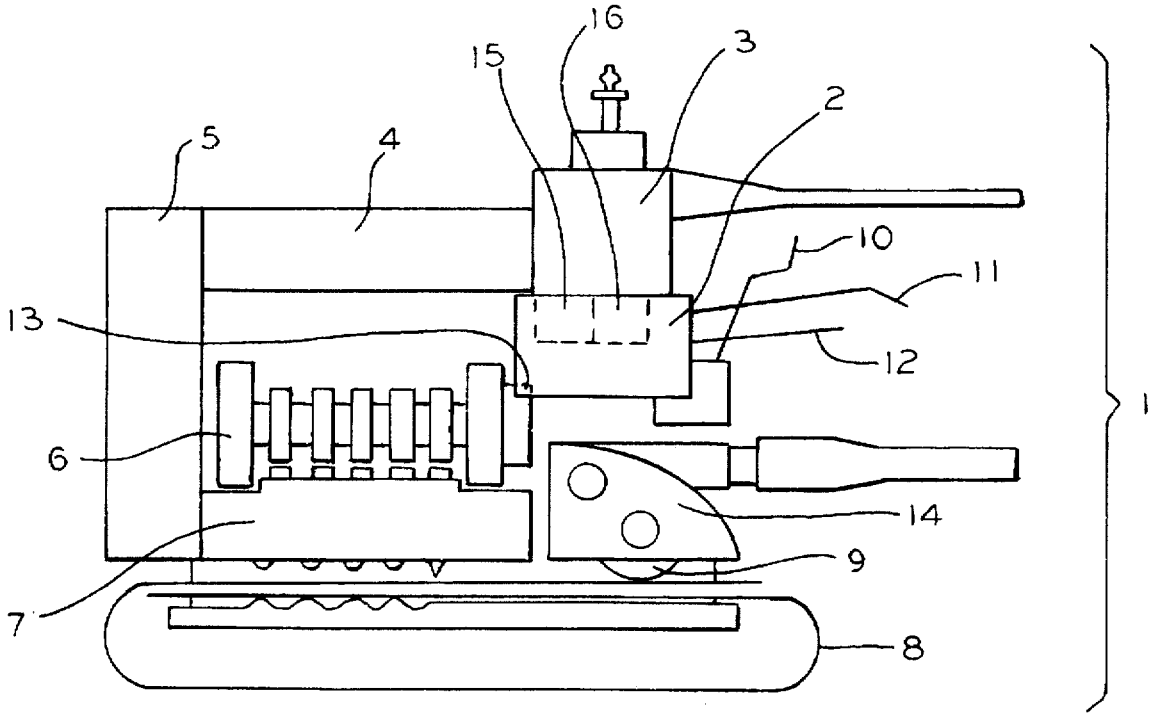
FIG. 1 is a side view of the strapping tool.
Figure 2:
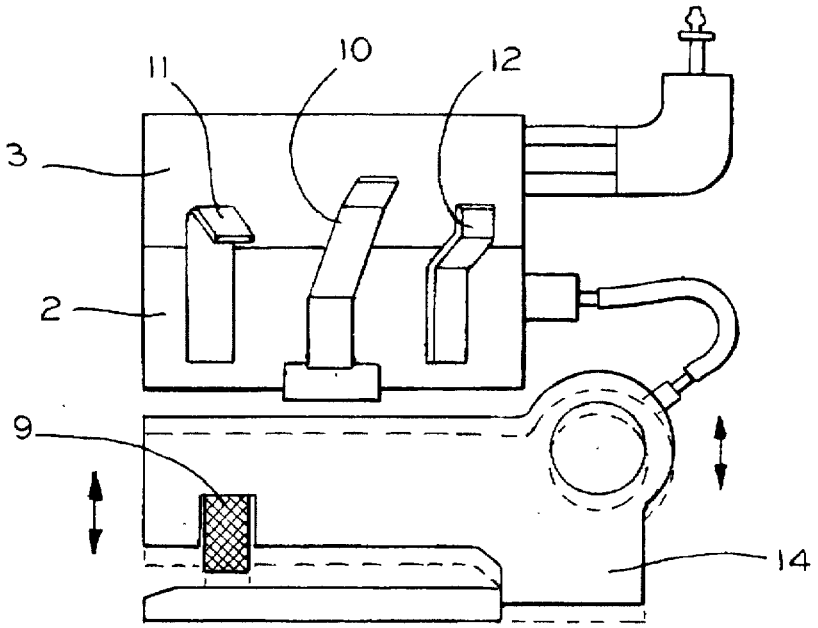
FIG. 2 is an end view of the strapping tool.

FIGS. 1 and 2 show an overall view of the present invention.

The strapping tool 1 includes a lever module 2 containing a sealer lever 11, a tension lever 12, and tension shut-off switch 10. A sealer valve 15 and a tension valve 16 are housed in a valve module 3. The valve module 3 and the sealer motor 4 are disposed together at the top of the strapping tool 1. A gearbox 5 is disposed in a generally vertical position at one end of the strapping tool. A sealer cam 6 having a plurality of cam surfaces for punching slits into a metal strap, and for cutting the strap, is disposed generally below and parallel with the sealer motor 4/valve module 3 arrangement. A sealer follower module 7 includes cam followers, and punching and cutting elements which are activated by the cam surfaces of the sealer cam 6.

A metal strap 8 may be inserted into the strapping tool 1 by rotating in an upward direction the tension motor/gear housing assembly 14.

In operation, the strap 8 may be drawn up manually to eliminate excess slack. The tension motor/gear housing assembly 14 is then released so that the tension wheel 9 rests against a top surface of the strap 8. Depressing the tension lever 12 activates the tension valve 16 and the tension motor/gear housing assembly 14, which rotates the tension wheel 9, causing it to move the strap 8 through the strapping tool, drawing the strap 8 to a desired tension level. The tension motor/gear housing assembly 14 is designed to stall if a predetermined tension level is exceeded, preventing overtightening of the strap. The sensor lever may be regulated by controlling the volume flow rate or the pressure of the supply air. Otherwise, the operator may depress sealer lever 11 at a desired moment, to seal the strap 8 and cut off a section from the strap feeding supply.

Depressing the sealer lever 11 disengages the tension motor/gear housing assembly 14, and engages the sealer valve 15 and the sealer motor 4. The sealer motor 4 drives the sealer cam 6 through the gearbox 5, rotating the sealer cam 6 one revolution. The surfaces on the sealer cam 6 act upon the elements in the sealer follower module, punching interlocking slits through overlapping sections of the strap 8, sealing the strap, and then cutting the sealed strap loose from the strap supply.

Figure 3:
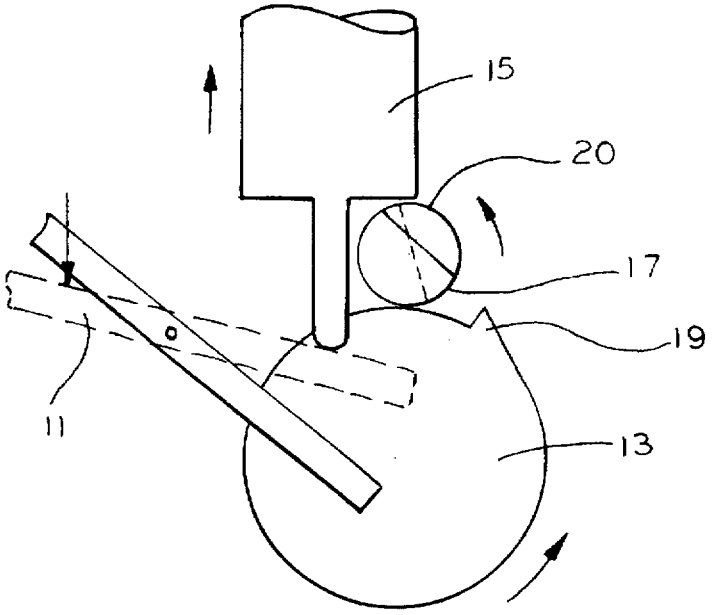
FIG. 3 is a schematic view of the sealer valve actuation and release mechanism in the sealing mode.
Figure 4:
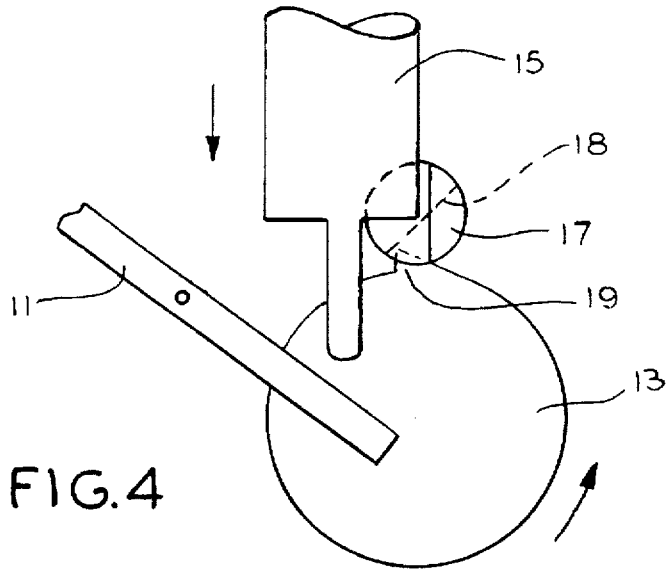
FIG. 4 is a schematic view of the sealer valve actuation and release mechanism in the non-sealing mode.
Figure 5:
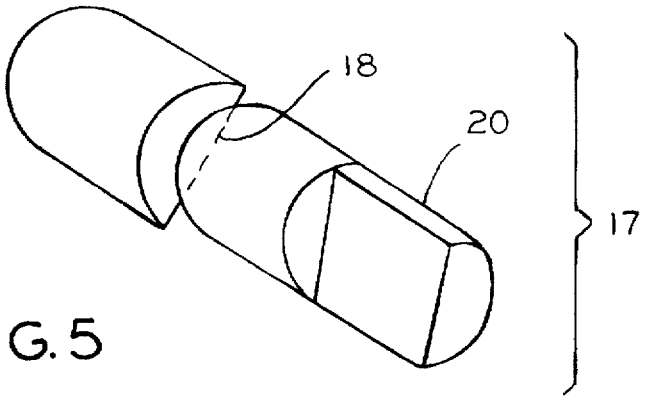
FIG. 5 is a perspective view of the pawl.

An improvement over the prior art involves the means for terminating the sealing step. Referring to FIGS. 3, 4, and 5, a compact and reliable structure is disclosed for terminating the sealing step, and reducing the size and weight of the strapping tool.

FIG. 3 shows the strapping tool in the sealing mode.

A release cam 13 is disposed on an end of the sealer cam 6 distal the gearbox 5. The direction of rotation is shown in FIG. 3. Here, the sealer lever 11 has been depressed in the direction shown by the arrow, and has returned to a rest position. The sealer valve 15 has been moved up into the ON position by the movement of the sealer lever 11, thereby activating the sealer motor 4 and associated apparatus. A pawl 17, being biased in one direction, the bias in this embodiment shown to be counterclockwise, rotates to present a sealer valve support surface 20 to a portion of the sealer valve 15, which may be biased downward by a spring force. The sealer valve support surface 20 holds the sealer valve 15 in the ON position.

FIG. 4 shows the strapping tool 1 in the non-sealing mode.

The release cam 13 has at this point in time rotated to present a release cam tooth 19 to the pawl 17. Specifically, the release cam tooth 19 acts against a release tooth surface 18, rotating the pawl 17 against its bias, and removing the sealer valve support surface 20 from contact with the sealer valve 15. This causes the sealer valve 15 to move in the direction of its spring bias to a closed position, to await the next sealing cycle. The direction of bias of the various elements may vary, depending on the specific embodiment, and the invention is therefore not limited to the specific embodiment shown in the schematic FIGS. 3 and 4.

FIG. 5 shows one embodiment of the pawl 17, including the sealer support surface 20 and the release tooth surface 18.

In one embodiment, the tension lever 12 is held in the ON position by the tension shut-off switch 10, which is biased to hold the tension lever 12 in the ON position. When the sealing lever 11 is activated, it releases the tension shut-off switch from its biased position against the tension lever 12, allowing the tension lever 12 to return to the OFF position. Also, the tension shut-off switch 10 may be manually released at any time during tensioning to terminate the tensioning of the strap.

The present invention, through the new design of the combined sealing motor/valve module, and the new means for terminating the sealing step, addresses and solves the problem of providing a compact, reliable, lightweight hand-held strapping tool.

Modifications and variations of the preferred embodiment of the present invention are encompassed by the disclosure as set out herein. The scope of the invention is to be only limited by the following claims.

I claim:

1. A compact hand-operated pneumatic strapping tool for the tensioning and sealing of a pair of overlapping strap sections around an object comprising:

A strap tensioning means for tensioning the overlapping sections of straps thereby defining a tensioning step, said tensioning means comprised of a pneumatic strap tensioning motor that includes a gear housing assembly connected to a tension wheel, said tension motor controlled by a tension lever that engages a tension valve, said tension valve for regulating air into said tensioning motor;

a sealer means for punching a plurality of interlocking slits through the overlapping strap sections thereby defining a sealing step, the sealer means comprised of a pneumatic strap sealing motor that includes a gear box, said gear box connected to a cam shaft having a sealer cam and a release cam attached thereto, said sealer motor controlled by a sealer lever that engages a spring-biased sealer valve, said sealer valve regulating air into said sealer motor upon downward depression of said sealer lever, thereby overcoming said spring bias, said sealer cam and release cam each having a respective cam surface, said release cam including a tooth thereon, said release cam located on a distal end of said cam shaft, opposite of said gear box, wherein said sealer means includes a sealer follower module for sealing the overlapping strap sections, said sealer follower module in contact against said sealer and release cam surfaces;

a valve module for housing the sealer valve and the tension valve, each of said valves having an on and an off position;

a sealer disengagement means for terminating the sealing step, the sealer disengagement means interposed between the release cam and the sealer valve, said sealer disengagement means disengaging the sealing of the overlapping strap sections by closing the sealer valve, the sealer disengagement means comprised of a spring-biased pawl having a release tooth with a release tooth surface and a sealer valve support with a sealer valve support surface, the tooth of the release cam in operative contact with the release tooth surface of the pawl when said sealer valve is closed, the sealer valve support surface of the pawl in operative contact with the sealer valve when said sealer valve is opened on a downward depression of the sealer lever, whereby an open condition of the sealer valve causes activation of said sealer motor, said sealer cam and said release cam, thereby causing a revolution of said release cam, whereby the release cam tooth engages against the release tooth surface of the pawl and overcomes said pawl bias to rotate the pawl in a manner which disengages the sealer valve support surface with the sealer valve and causes termination of the sealing step, and wherein a successive downward depression of the sealed lever causes disengagement of the release cam tooth with the release tooth surface of the pawl, allowing the pawl bias to rotate the pawl such that the sealer valve support surface holds the sealer valve in the open and on position, causing a beginning of the next successive sealing step.

2. The compact hand-operated pneumatic strapping tool according to claim 1, wherein the pawl is spring-biased to support the sealer valve against the sealer valve support surface.

3. A compact hand-operated pneumatic strapping tool according to claim 2, further comprising a tension shut-off switch, the tension shutoff switch normally biased to hold the tension lever in the on position, wherein when the sealer lever is moved to the on position, the tension shut-off switch disengages with the tension lever, wherein the tension lever moves to the off position, terminating the tensioning step.

4. The compact hand-operated pneumatic strapping tool according to claim 3, wherein the sealer valve and the tension valve are contained in a compact valve module, the valve module and sealer motor disposed adjacent one another along a top area of the strapping tool, substantially parallel to the sealer cam, the gearbox disposed in a generally vertical position at an end distal the valve module, wherein components are arranged to minimize the size of the strapping tool.

* * * * *